US010926270B2

(12) United States Patent
Wulfert et al.

(10) Patent No.: US 10,926,270 B2
(45) Date of Patent: Feb. 23, 2021

(54) METHOD FOR OPERATING A MULTI-CYCLONE FOR THE SEPARATION OF FINE AND VERY FINE GRAIN AS WELL AS A MULTI-CYCLONE

(71) Applicant: Loesche GmbH, Duesseldorf (DE)

(72) Inventors: Holger Wulfert, Duesseldorf (DE); André Bätz, Duesseldorf (DE); Winfried Ruhkamp, Duesseldorf (DE)

(73) Assignee: Loesche GmbH, Duesseldorf (DE)

( * ) Notice: Subject to any disclaimer, the term of this patent is extended or adjusted under 35 U.S.C. 154(b) by 180 days.

(21) Appl. No.: 16/067,373

(22) PCT Filed: Sep. 8, 2017

(86) PCT No.: PCT/EP2017/072546

§ 371 (c)(1),
(2) Date: Nov. 30, 2018

(87) PCT Pub. No.: WO2018/046640

PCT Pub. Date: May 15, 2018

(65) Prior Publication Data

US 2019/0015840 A1 Jan. 17, 2019

(30) Foreign Application Priority Data

Sep. 9, 2016 (EP) ..... 16188007

(51) Int. Cl.
*B02C 23/14* (2006.01)
*B02C 15/00* (2006.01)
(Continued)

(52) U.S. Cl.
CPC ..... *B02C 23/14* (2013.01); *B02C 15/007* (2013.01); *B02C 23/18* (2013.01); *B02C 23/26* (2013.01);
(Continued)

(58) Field of Classification Search
CPC ..... B02C 23/14; B02C 23/18; B02C 23/26; B02C 23/32; B02C 23/30;
(Continued)

(56) References Cited

U.S. PATENT DOCUMENTS 2,799,355 A 7/1957 Anderson
4,061,274 A * 12/1977 Williams ..... B02C 21/00 241/19
(Continued)

FOREIGN PATENT DOCUMENTS

CN 1036578 10/1989
DE 4224704 1/1994
(Continued)

OTHER PUBLICATIONS

International Search Report & Written Opinion dated Dec. 22, 2017 for PCT/EP2017/072546 filed Sep. 8, 2017, pp. 1-8.
(Continued)

*Primary Examiner* — Faye Francis
(74) *Attorney, Agent, or Firm* — Dinsmore & Shohl LLP

(57) ABSTRACT

The invention relates to a multi-cyclone and to a method for operating such a multi-cyclone for separating fine material and very fine material. In this context, a multi-cyclone according to the invention has multiple individual cyclones which are of essentially identical construction and which are housed in a housing that has an upper and a lower chamber. Via a supply into the lower chamber it is possible to introduce in a targeted manner cyclone regulating air which can be used to set the quantity, the fineness and/or the purity of the material separated by means of the multi-cyclone.

15 Claims, 4 Drawing Sheets

(51) Int. Cl.

| | |
|---|---|
| ***B04C 5/185*** | (2006.01) |
| ***B04C 5/28*** | (2006.01) |
| ***B04C 11/00*** | (2006.01) |
| ***B04C 5/14*** | (2006.01) |
| ***B04C 5/12*** | (2006.01) |
| ***B02C 23/18*** | (2006.01) |
| ***B02C 23/26*** | (2006.01) |
| ***B02C 23/32*** | (2006.01) |
| ***B02C 23/30*** | (2006.01) |
| *B04C 9/00* | (2006.01) |

(52) U.S. Cl.
CPC ..... *B02C 23/30* (2013.01); *B02C 23/32* (2013.01); *B04C 5/12* (2013.01); *B04C 5/14* (2013.01); *B04C 5/185* (2013.01); *B04C 5/28* (2013.01); *B04C 11/00* (2013.01); *B02C 2015/002* (2013.01); *B04C 2009/002* (2013.01)

(58) Field of Classification Search
CPC ..... B02C 2015/002; B04C 5/14; B04C 5/12; B04C 5/185; B04C 5/28
USPC ..... 241/79.1
See application file for complete search history.

(56) References Cited

U.S. PATENT DOCUMENTS

| | | | | |
|---|---|---|---|---|
| 5,050,808 | A * | 9/1991 | Satake | B02C 4/32 241/101.3 |
| 5,915,635 | A * | 6/1999 | Cannell | B02C 19/06 241/24.1 |
| 8,066,211 | B2 * | 11/2011 | Hagedorn | B02C 23/14 241/75 |
| 2017/0056890 | A1 * | 3/2017 | Fischer | B29B 17/0408 |
| 2018/0036803 | A1 * | 2/2018 | Yamamoto | B02C 23/38 |

FOREIGN PATENT DOCUMENTS

| | | |
|---|---|---|
| FR | 1517649 A | 3/1968 |
| FR | 1584200 | 12/1969 |

OTHER PUBLICATIONS

International Search Report & Written Opinion dated Sep. 9, 2016 for PCT/EP2017/072546 filed Sep. 8, 2017, pp. 1-14.

* cited by examiner

METHOD FOR OPERATING A MULTI-CYCLONE FOR THE SEPARATION OF FINE AND VERY FINE GRAIN AS WELL AS A MULTI-CYCLONE

The invention concerns a method for operating a multi-cyclone for separating fine and very fine grain as well as a multi-cyclone.

Generic methods with several essentially identically designed individual cyclones are known, each with a carrier gas inlet opening, a carrier gas outlet opening, and a grit discharge opening. The individual cyclones are housed together in a low-infiltrated-air housing, in which an upper and a lower chamber is designed. The carrier gas outlet openings of the individual cyclones are open towards the upper chamber and the upper chamber has a carrier gas overall outlet opening. This serves to discharge the carrier gas, which has escaped from the respective carrier gas outlet openings of the individual cyclones, into the upper chamber, from the housing of the multi-cyclone via the carrier gas overall outlet opening. The grit discharge openings of the individual cyclones are each designed open towards the lower chamber. In addition, the lower chamber has a device for the low-infiltrated-air extraction of cyclone grits introduced through the grit outlet openings. Furthermore, a common cyclone control air supply is provided to the lower chamber.

Individual cyclones are also called centrifugal separators. They serve, for example, as so-called mass force separators in procedural plants for the separation of solid particles from gases. They are used, for instance, in gas cleaning. The aim here is to use the cyclone to remove particles as completely as possible, i.e. up to a very high degree of purification, from the carrier gas, which transports the particles into the cyclone, and to discharge the carrier gas again from the cyclone.

Ideally, a degree of purification of over 99% is here achieved, depending on the particle size and mass.

The essential components of a centrifugal separator are an upper inlet cylinder, a conical extension of this cylinder, and an immersion tube. A cyclone works as follows: carrier gas containing the particles to be separated is blown tangentially into the inlet cylinder so that it defines a circular path. The particles located in the carrier gas are guided by their centrifugal force to the wall of the cylindrical area and then decelerated in the subsequent conical area, in particular on the cone walls, so that they fall out of the carrier gas flow and leave the cyclone in a downward direction. The carrier gas cleaned in this way exits the cyclone via the immersion tube, which extends inside the inlet cylinder and the subsequent cone.

From PCT/EP2015/066348 it is known that a cyclone can also be used for separating or classifying of fine particles. This teaches that the separation properties of the cyclone can be partly influenced by the inflow velocity of the carrier gas flow into a cyclone. However, since the carrier gas flow or process gas flow in procedural plants often cannot be influenced at will due to other equipments installed in such plants, such a control has not always proven to be optimally feasible.

The invention is therefore based on the object of creating a simple and efficient method for operating a multi-cyclone for separating fine and very fine grain as well as a multi-cyclone.

According to the invention, this object is solved by a method for operating a multi-cyclone for separating fine and very fine grain with the features of claim 1 and by a multi-cyclone with the features of claim 8.

Advantageous embodiments of the invention are specified in the sub-claims and the description as well as their figures and their explanations.

In the method according to the invention, the carrier gas inlet openings are each supplied from outside the housing with a carrier gas flow of equal volume with the fine and very fine grain to be separated. In the individual cyclones of the multi-cyclone, an at least partial separation of fine and very fine grain is carried out, whereby the fine grain enter into the lower chamber as cyclone grit via the grit discharge openings and from there are discharged out of the housing via the device for low-infiltrated-air outlet. The very fine particles are directed as cyclone fines through the upper chamber and the carrier gas outlet opening out of the multi-cyclone by means of the carrier gas flow. It is also intended that by controlling the quantity per unit of time of cyclone control air fed into the lower chamber by the cyclone control air supply, the quantity, the fineness, and/or the purity of the very fine particles fed from the multi-cyclone is adjusted.

The device for low-infiltrated-air extraction thus can be understood therein that it is possible, for example, to extract the fine particles from an individual cyclone as cyclone grit without a disproportionate amount of air entering the inside of the cyclone in this connection. This entering unwanted air is called infiltrated air. The aim is to prevent air from entering, i.e. to design the device so as to be free from infiltrated air. This is not possible for practical reasons, which means that at best it can be assumed that the extracting device is largely free from infiltrated air. This can be by means of a rotary valve, for example, so that no air or as little air as possible flows into the inside of the cyclone, but the fine grain can be discharged. Other possibilities include appropriately constructed locks.

Low false air or low infiltrated air in the meaning of the invention can be understood to mean that hardly any or ideally no air or gas can penetrate into the multi-cyclone from outside the multi-cyclone. However, a complete prevention of the penetration of false air or infiltrated air cannot be achieved under real conditions, or only with an unreasonable amount of effort. The main reason for the entry of infiltrated air into the multi-cyclone is the device for the low-infiltrated-air extraction of cyclone grits discharged through the grit discharge openings. Such a device can, for example, be implemented as a rotary valve. Rotary valves that meet the requirements of the invention described here have a gap width, for example, of approx. 0.3 mm. Overall, it is possible to state that the introduction of false air in the meaning of the invention is ideally as close to zero as possible, but in real scenarios should be within a maximum range of 1%.

The term "carrier gas flow" is used in this description. In the meaning of the invention, this can be a gas or air flow with which the particles to be separated, which are referred to as fine and very fine particles, are transported. In principle, any gas or gas mixture can be used for this. This can, for example, be ambient air, oxygen-depleted process gas, or similar.

A basic idea behind the invention can be seen in supplying each of the individual cyclones provided in the multi-cyclone with a carrier gas flow of equal volume. As a result, the individual cyclones essentially have the same separation characteristics between fine and very fine particles, which considerably simplifies control of this separation limit over the entire multi-cyclone.

Furthermore, according to the invention, it has been recognized that for the purpose of a simple design and simple control of the multi-cyclone, it is preferable to use cyclone control air as the control variable for the separation limit, i.e. in particular for the quantity, fineness, and/or purity of very fine particles. Simple control is also provided by the fact that the cyclone control air is not fed to each individual cyclone separately; rather, a common single supply of cyclone control air to the lower chamber of the multi-cyclone is provided. Of course, several supplies could also be provided in the lower chamber depending on the design. However, it is essential that the supply and thus the control of the cyclone control air takes place in the lower chamber and not directly in each individual cyclone itself.

As a central feature of the invention, it has been recognized that the supply of cyclone control air disturbs the vortex or vortex sink formed within the cyclone, so that no 99% or no even better separation of the solid particles in the carrier gas flow is no longer possible. Coarser particles, i.e. particles with a higher density, tend to be separated further whereas smaller or finer particles with a lower density can no longer be separated from the carrier gas flow and are carried out together with and via the carrier gas flow exiting from the cyclone.

It is advantageous if the volume per unit of time of the carrier gas flows of equal volume to the individual cyclones is adjusted depending on the geometry of the individual cyclones used in order to separate approx. 99% of the fine and very fine particles contained in the carrier gas flows as cyclone grit when the cyclone control air supply is closed. It has transpired that a basic state set in this way can be regulated or controlled particularly efficiently and effectively by means of the supply of cyclone control air. This results due to the fact that the individual cyclones of the multi-cyclone are operated in this basic state in such a way that they allow a separation of the fine and very fine particles as complete as possible. Subsequently, this separation can be worsened by the supply of cyclone control air, so that the goal is achieved of removing part of the particles contained in the carrier gas flow as very fine particles from the multi-cyclone by means of the carrier gas overall outlet flow and feeding it to a later separation.

Alternatively or in addition to adjusting the volume per unit of time of the carrier gas flows of equal volume to the individual cyclones, the loading of the carrier gas flows of equal volume to the individual cyclones with fine and very fine particles can also be adjusted depending on the geometry of the individual cyclones in order to separate approx. 99% of the fine and very fine particles contained in the carrier gas flows as cyclone grit with the cyclone control air supply closed. Similar to the volumes per unit of time of the carrier gas flows of equal volume, the loading of the carrier gas flows of equal volume with particles, which can be separated as fine and very fine particles, is also a relevant variable for adjusting a stable basic state. The load can be expressed in grams of dust particles per cubic meter of carrier gas or in kilograms of dust particles per kilogram of carrier gas.

Setting a load that fulfills the conditions above is preferable, as, if the load is too high, no 99% separation of fine and very fine particles as cyclone grit is not possible, and thus the control via cyclone control air is made more difficult. According to a desire the load should be optimized as far as possible, as the load has a significant influence on the efficiency of the multi-cyclone. This means, that the closer the load is to the optimum, i.e. with a 99% separation without the supply of cyclone control air, the higher a throughput that can be achieved with such a multi-cyclone.

It is preferred if a pressure difference between the upper and lower chambers is adjusted during operation and the pressure in the upper chamber is lower than the pressure in the lower chamber. This can be achieved, for example, by a suction fan after the multi-cyclone, so that a pressure drop occurs throughout the entire multi-cyclone. As a result, the static pressure in the upper chamber is lower than in the lower chamber. This makes it easy to ensure that the cyclone control air introduced into the lower chamber flows through the individual cyclones into the upper chamber and thus has the desired effect on the separation properties of the individual cyclones.

In this respect, it is advantageous if the pressure in the upper chamber and in the lower chamber is set lower than the ambient pressure. This ensures that the cyclone control air does not have to be blown into the multi-cyclone itself, but is sucked into this. Such a procedure facilitates the construction and operation of a multi-cyclone, as it is necessary in the procedure either to actively blow the carrier gas flows into the multi-cyclone or, as is preferred, to suck them through the multi-cyclone via a fan.

In principle, the fine and very fine particles to be separated can be fed directly into a carrier gas flow. However, it is advantageous if the fine and very fine particles to be separated are fed into a dispersing unit before the feeding the multi-cyclone by means of the carrier gas, and from there transported to the multi-cyclone by means of the carrier gas flow. Such a procedure is particularly advantageous if the fine and very fine particles are not fed directly from an upstream process via the carrier gas flow, but from a storage point like a hopper. By using a dispersing unit, the fine and very fine particles are distributed as homogeneously as possible in the carrier gas flow and hardly any particles adhere to each other. This has a positive influence on the result of separation in the multi-cyclone.

In principle, the very fine particles, which are discharged from the multi-cyclone by means of the carrier gas outlet flow, can be separated from the carrier gas flow in any way. It is advantageous if this is done by means of a filter. Examples of filters that can be used are a bag filter or cartridge filter.

The method as proposed by the invention can be advantageously applied to a multi-cyclone with several essentially identically designed individual cyclones. Each of these individual cyclones has a carrier gas inlet opening, a carrier gas outlet opening, and a grit discharge opening. The individual cyclones are housed together in a low-infiltrated-air housing, in which an upper and a lower chamber is designed. The carrier gas outlet openings of the individual cyclones are open designed towards the upper chamber. This upper chamber has a carrier gas overall outlet opening to discharge the carrier gas which enters into the upper chamber from the respective carrier gas outlet openings of the individual cyclones via this carrier gas overall outlet opening from the housing of the multi-cyclone. The grit discharge openings of the individual cyclones are each open towards the lower chamber, whereby the lower chamber has a device for low-infiltrated-air extraction of cyclone grits introduced through the grit discharge opening.

The carrier gas inlet openings are designed in such a way that they can each be supplied with a carrier gas flow of equal volume from outside the housing of the multi-cyclone and are not connected flow-wise to the upper or lower chamber. A common cyclone control air supply is provided to the lower chamber, via which cyclone control air can selectively be directed into the lower chamber. In addition, a control and regulating device is provided and set up to adjust the quantity, the fineness, and/or the purity of the very fine particles directed from the multi-cyclone by means of the quantity of cyclone control air per unit of time.

With such a design as according to the invention, it is relatively easy possible to adjust the quantity, fineness, and/or purity of the very fine particles separated by means of the multi-cyclone by adjusting the cyclone control air quantity per unit of time.

The overall structure of the multi-cyclone is such that there is a common cyclone control air supply to all individual cyclones. This means that only one supply, which leads centrally into the lower chamber, has to be adjusted and/or controlled to influence the previously mentioned properties of the very fine particles.

To make this easy, the individual cyclones are connected flow-wise to the lower chamber via their grit discharge openings. Supplying cyclone control air via the lower chamber and the grit discharge openings into the individual cyclones influences the vortex sink, which each forms in the individual cyclones and is significantly responsible for the separation efficiency or other separation properties in a cyclone. The more this vortex sink is influenced, the more the separation limit shifts from the area of very fine particles to the area of fine particles.

The advantage of such a design is that the carrier gas flow, which is fed to the individual cyclones, does not have to be modified or influenced. This means that the multi-cyclone is set once during operation to an ideally optimum operating point and then the separation properties only have to be varied and readjusted via the quantity of cyclone control air supplied per unit of time.

The design of the multi-cyclone according to the invention thus has the advantage that the multi-cyclone can basically be set at an optimum operating point with regard to the quantity of carrier gas flowing in and the loading of this, and can therefore be operated efficiently.

In principle, the individual cyclones can be arranged in any order in the multi-cyclone. With regard to a simple control of the multi-cyclone, it is preferred if the individual cyclones are provided in parallel, flow-wise, in the housing. This means that they all have in each case a single carrier gas inlet opening, which is supplied with carrier gas loaded with particles from outside the multi-cyclone.

The parallel arrangement ensures that the individual cyclones, which are essentially identical in design, each behave in the same way and thus exhibit similar separation behavior. Another advantage is that the multi-cyclone can be easily scaled by providing additional individual cyclones in parallel, as these only have to be provided in the common housing. Here, the advantage of a common cyclone control air supply is evident, in that no additional new cyclone control air supply is necessary for an additional individual cyclone.

It is preferred when the upper and lower chambers are designed to be airtight to each other, whereby an air exchange between the upper and lower chambers essentially only takes place via the individual cyclones. Airtight in this context means that an air exchange between the two chambers can only take place via or through the individual cyclones, so that no direct air exchange between these two chambers is provided. The result of the airtight separation of the upper and lower chambers is that the cyclone control air can only flow into the individual cyclones via the grit outlet openings of the individual cyclones and into the upper chamber via the carrier gas outlet openings. Such a design ensures that the cyclone control air introduced into the lower chamber flows completely through the individual cyclones and is thus fully used to control the separation between fine and very fine particles.

A multi-cyclone according to the invention can preferably be used or installed in within a very fine particle separator for separating fine and very fine particles from a preliminary or intermediate product. In addition to a multi-cyclone according to the invention, such a very fine particle separator features a filter connected after or downstream of the multi-cyclone. The preliminary or intermediate product is fed to at least one multi-cyclone by means of a carrier gas flow. In the multi-cyclone, the fine particles can be separated as cyclone grit. Afterwards, the very fine particles, which are still in the carrier gas flow, are directed further to the filter, where they can be separated. Such a very fine particle separator easily enables the carrier gas flow exiting from the multi-cyclone, in which flow the very fine particles not separated in the cyclones are present, to be further treated so that the very fine particles can also be recovered from the carrier gas flow, and the carrier gas flow itself can either be fed back into the process or directed into the environment.

Furthermore, it is possible to provide several multi-cyclones in serie one after the other before the filter, flow-wise. In each case the individual cyclones of the multiple multi-cyclones each is equipped with a smaller diameter in the flow direction of the carrier gas flow. In other words, several multi-cyclones can be placed in a cascading arrangement before the filter, whereby the diameter of the individual cyclones decreases the closer the multi-cyclone is positioned to the filter in the direction of flow.

The diameter of an individual cyclone is essentially responsible for the possibilities for adjusting the separation limit. The smaller the diameter, the further the separation limit between fine and very fine particles can be shifted in the direction of very fine particles or smaller diameter, so that very fine particles are finer. With such a cascading arrangement of several multi-cyclones, it is thus possible to produce different fractions of fine or very fine particles with a very fine particle separator.

In principle, the preliminary or intermediate product can be fed directly to the very fine particle separator from a procedural plant, for example a grinding process. However, since in this case the volumes of the carrier gas flows are often defined based on the upstream process, it is not easy to operate the multi-cyclone at an efficient operating point.

It is therefore advantageous if a storage hopper for the preliminary and intermediate product as well as a dispersing unit are provided upstream of the multi-cyclone or multi-cyclones of the very fine particle separator. The preliminary or intermediate product to be separated is fed from the storage hopper via the dispersing unit to the very fine particle separator by means of the carrier gas flow. With such a design, the very fine particle separator can be uncoupled from an upstream process and thus operated independently from the operating condition of the latter. The use of a dispersing unit after the storage hopper has proven to be advantageous, as the dispersing unit ensures that the fine and very fine particles to be conveyed further by means of the carrier gas flow are available homogeneous and essentially free of attachments in the carrier gas flow, so that a good separation in the multi-cyclone is possible.

The very fine particle separator can also be used in a grinding plant to produce fine and very fine particles from a raw material. Such a grinding plant features a mill-sifter combination, having a sifter and a mill. The mill-sifter combination is designed to feed raw material ground at least once in the initial sifting from the sifter of the mill-sifter combination back to the mill as rejected coarse material for further grinding.

A grinding plant filter is also provided. By means of a grinding plant carrier gas flow, granded ground material not rejected by the sifter of the mill-sifter combination is transported to the grinding plant filter where it is separated from the grinding plant carrier gas flow. Then, directly or indirectly, for example via a hopper, the granded ground material separated at the grinding plant filter is fed to the very fine particle separator where it is separated into fine and very fine particles.

Basically, any mill construction can be used that enables the ground material to be ground to the desired fineness. It has proven advantageous to use a vertical mill featuring grinding table and grinding rollers for this, as this achieves a good grinding result and a wide range of particle fractions are produced during grinding, which means that fine and very fine particles of both fractions are present in the carrier gas flow. Another advantage is that a vertical mill can be operated relatively energy efficiently in this method compared to ball mills.

The invention is explained below using examples with schematic figures.

Figure 1:
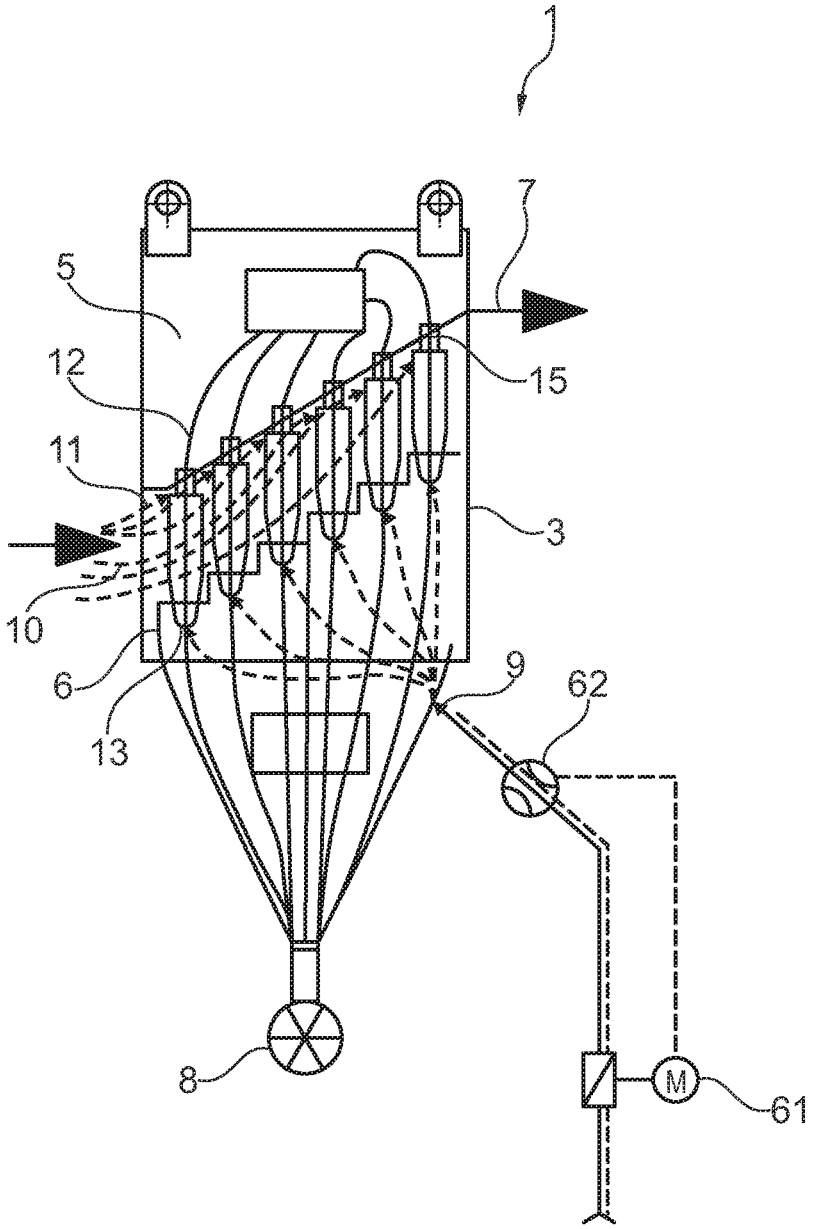
FIG. 1 shows a sketch of a multi-cyclone according to the invention.

FIG. 1 shows a schematic diagram of a multi-cyclone 1 according to the invention. In the multi-cyclone 1, several individual cyclones 10 of identical design are arranged in a housing 3, in the design example shown here, six by six, i.e. 36. In FIG. 1 only six individual cyclones 10 are visible. The further individual cyclones 10 are located in the depth directions of the sketch. The individual cyclones 10 are preferably used in a square arrangement.

The individual cyclones 10 are essentially of identical design and each have a carrier gas inlet opening 11, a carrier gas outlet opening 12, and a grit discharge opening 13. The housing 3 is divided into an upper chamber 5 and a lower chamber 6 by means of a separation 15.

Each of the individual cyclones 10 are arranged between the upper chamber 5 and the lower chamber 6. The carrier gas inlet openings 11 of the individual cyclones 10 are designed so that they can be operated with a carrier gas flow from outside the housing 3. The carrier gas is fed into the carrier gas inlet openings 11 of the individual cyclones 10 directly from outside the housing 3, so that the carrier gas does not first penetrate into the upper chamber 5 or lower chamber 6.

Each individual cyclone 10 is connected flow-wise to the upper chamber 5 via its carrier gas outlet opening 12. In the same way, each individual cyclone 10 is connected flow-wise to the lower chamber 6 via its grit discharge opening 13. The upper chamber 5 has a carrier gas overall outlet opening 7 through which carrier gas, which enters the upper chamber 5 from the carrier gas outlet openings 12 of the individual cyclones 10, can exit.

The lower chamber 6 is equipped with a device for low-false-air or low-infiltrated-air extraction of cyclone grits. This device can be designed as a rotary valve 8, for example, so that the cyclone grits can be discharged from the lower chamber 6 without larger quantities of air entering the lower chamber 6.

In addition, a cyclone control air supply 9 is provided in the lower chamber 6. Air or gas can be selectively directed into the lower chamber 6 via this cyclone control air supply 9. For this purpose, a volume flow measurement 62 and a control valve 61 are mounted in front of the cyclone control air supply 9, with which the volume or the quantity of cyclone control air introduced into the lower chamber 6 can be varied and adjusted.

In the following, the operation and function of the multi-cyclone 1 according to the invention will be explained in more detail.

According to the invention, the multi-cyclone 1 is not used for removing particles from an air or gas flow as is customary, but as a targeted separation unit for particles present within a carrier gas flow. For this purpose, a carrier gas flow is fed into the individual cyclones 10, each of which is arranged in parallel flow-wise, i.e. side by side and in a row, with a corresponding particle load.

In the context of the invention, reference is made in this respect to fine and very fine particles, whereby a separation between fine and very fine particles is to be carried out. The carrier gas loaded with particles is divided among the individual cyclones 10 with an equal volume per unit of time and an equal particle loading, so that the individual cyclones 10 have separation characteristics that are as identical as possible. Due to the geometry of the inlet cylinder and the cone of the individual cyclones 10, it is possible to separate the particles from the carrier gas flow in a familiar manner. The separated particles are transferred via the grit discharge opening 13 as cyclone grits into the lower chamber 6 or fall into this. The carrier gas, essentially cleaned of the particles, can then penetrate in the upper chamber 5 via the carrier gas outlet opening 12 from the individual cyclones 10 and in turn leave this via the carrier gas overall outlet opening 7.

In individual cyclone 10, the particles are separated essentially by the fact that the carrier gas with the particles being on a circular path is further accelerated through the geometry of the cyclone, so that the particles leave the accelerated carrier gas flow due to centrifugal force and gravity and fall out downwards via the grit discharge opening 13. The carrier gas cleaned in this way can then escape from the individual cyclone 10 via a provided immersion tube, as already described, and via the carrier gas outlet opening 12.

The flow conditions that occur within an individual cyclone 10 are also known as the vortex sink. If this vortex sink is disturbed, for example by cyclone control air flowing into the individual cyclone 10 via the grit discharge openings 13, the flow velocity of the carrier gas in the individual cyclone 10 changes so that even lighter particles, which are referred to here as very fine particles, can exit the individual cyclone 10 via the immersion tube and are separated not as cyclone grit via the grit discharge opening 13.

The invention makes use of this knowledge by specifically feeding cyclone control air into the lower chamber 6 of the multi-cyclone 1 via the cyclone control air supply 9. It is essential to ensure that the supplied cyclone control air flows through the individual cyclones 10 and influences the vortex sink. This can be done, for example, by providing a suction fan downstream of the carrier gas overall outlet opening 7, which sucks the carrier gas through the multi-cyclone 1. In this way, the static pressure in the upper chamber 5 is lower than in the lower chamber 6, where in turn the pressure there is lower than the ambient pressure. In this way, the cyclone control air can be supplied to the lower chamber 6 by opening and closing the control valve 62.

To achieve an effective operation of the multi-cyclone 1 according to the invention, it has proven to be advantageous to adjust the quantity of the carrier gas and the loading of this with particles in such a way to achieve a 99% or even better separation of the particles in the individual cyclones 10 with cyclone control air supply 9 closed. If cyclone control air is now purposefully supplied, the separation rate can be changed so that a part of the particles can be discharged as very fine particles via the carrier gas overall flow exiting from the multi-cyclone 1 and can later be separated from this.

In other words, by means of the cyclone control air can be used to adjust the mass flow distribution between very fine particles, which are discharged from the multi-cyclone, and fine particles, which are separated as cyclone grit in the multi-cyclone. This means that with a completely open cyclone control air supply 9 almost 100% of the particles present in the carrier gas flow are removed from the multi-cyclone 1 via the overall carrier gas outlet opening 7. In contrast, almost 100%, more precisely approximately 99%, of the particles in the carrier gas flow are separated as cyclone grit in multi-cyclone 1 when the cyclone control air supply 9 is completely closed.

For example, it is possible when inputting particles to be separated with 5000 Blaine, i.e. approx. D50=8 μm, and using individual cyclones with a diameter of 150 mm, to separate very fine particles with a fineness of D50<6 μm with a correspondingly adjusted cyclone control air quantity. In principle, it can be stated that the area of the optimum separation is essentially also defined by the geometry, in particular the diameter of the individual cyclones. This can also be called as selectivity of an individual cyclone. In connection with the cyclone control air, the fineness of the fine particles can be defined and readjusted in this way within a certain band range.

The D50 value describes the particle size distribution in a particle distribution where 50 wt. % is larger and 50 wt. % is smaller than the specified diameter of the limit particle. It has transpired, especially with the finenesses shown here, that this size is better suited than the usual specific surface according to Blaine.

Figure 2:
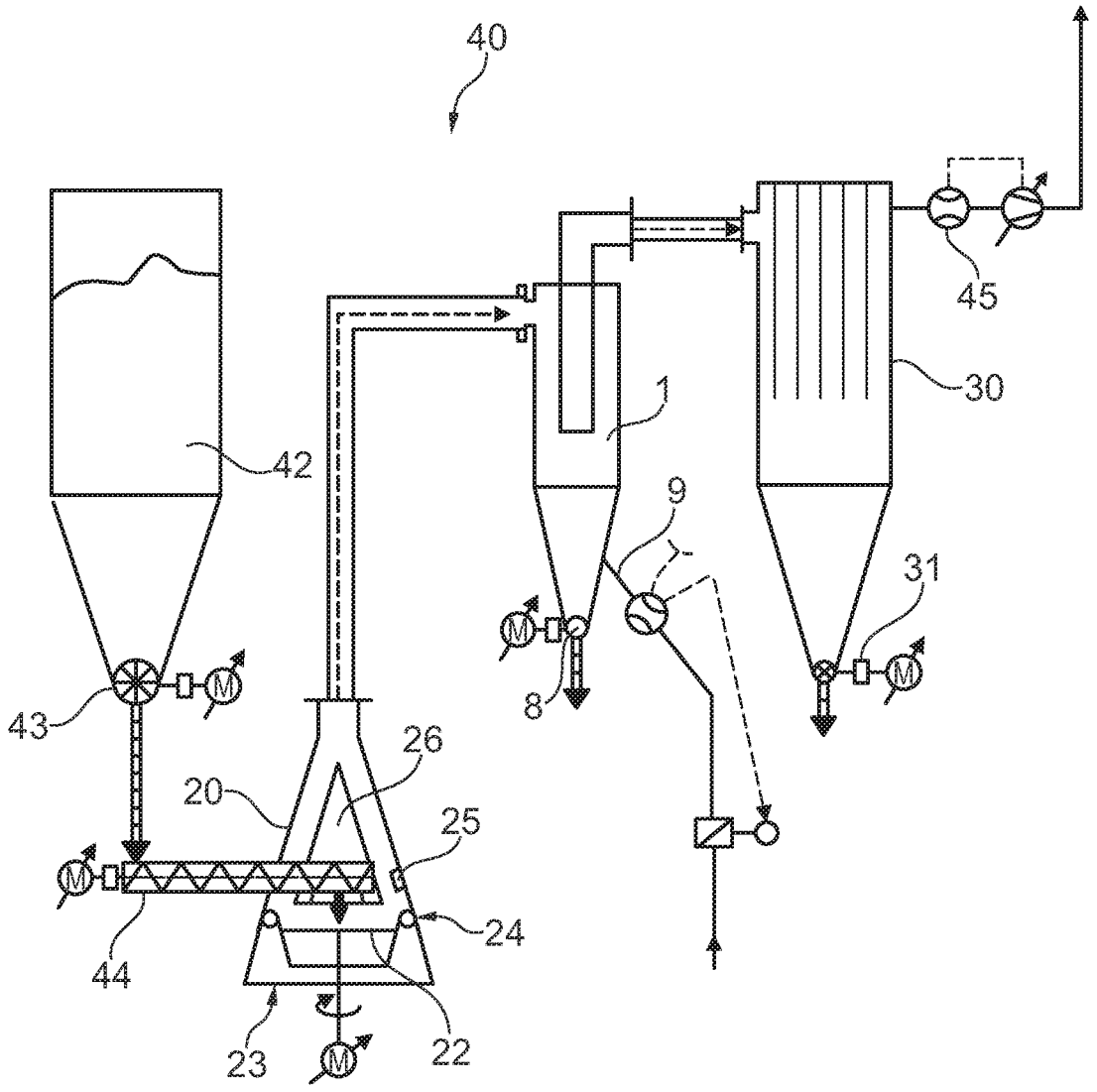
FIG. 2 shows a schematic flow diagram of a very fine particle separator according to the invention with dispersing unit and storage hopper.

FIG. 2 shows the multi-cyclone 1 according to the invention in the context of a very fine particle separator 40. As essential elements, the very fine particle separator 40 has a storage hopper 42 for a preliminary or intermediate product to be separated.

Furthermore, a dispersing unit 20 is provided to be able to distribute the preliminary or intermediate product to be separated as homogeneously as possible in a carrier air flow. This is followed by a multi-cyclone 1 according to the invention, followed downstream by a filter 30, which is preferably designed as a bag filter.

In the following, the design of the very fine particle separator 40 will be discussed in more detail, including a description of its function and mode of operation.

The preliminary or intermediate product stored in hopper 42 is fed via a rotary valve 43 to a speed-controlled screw conveyor 44, which feeds the preliminary or intermediate product to the dispersing unit 20. In principle, the discharge from the hopper and the feeding to the dispersing unit 20 can also be achieved by other means.

As already explained, the dispersing unit 20 serves to distribute the product to be separated as homogeneously as possible in a carrier gas flow. The dispersing unit 20 shown schematically in FIG. 2 is described as an example, whereby differently designed dispersing units can also be used.

To generate the carrier gas flow into which the preliminary and intermediate product is introduced, a fan 45 with corresponding control is provided downstream of the filter 30. This fan 45 sucks the carrier gas through the filter 30, the multi-cyclone 1, and the dispersing unit 20.

For this purpose, air intake openings 23 are provided in the dispersing unit 20. The dispersing unit 20 itself has a distributor plate 22, a blade ring 24, turbulence fixtures 25, and a displacement body 26. The preliminary or intermediate product fed to the dispersing unit 20 via the screw conveyor 44 falls onto the distributor plate 22. The distributor plate 22 rotates, so that the fed preliminary or intermediate product slides off at the side of the distributor plate 22 or is flung onto a wall of the dispersing unit 20. It is thus mechanically torn apart and distributed over a larger flow cross-section. Due to the carrier gas already described above, which flows through the air intake openings 23 and is additionally swirled by means of the blade ring 24, which is arranged at the edge of the distributor plate 22, the preliminary or intermediate product to be separated is swept along by the carrier gas flow. The rapidly entering carrier gas causes the preliminary or intermediate product to be torn apart again, in this case pneumatically.

To achieve an even better dispersion, turbulence installations 25 are provided in the flow direction of the carrier gas, which achieve an additional turbulence and thus better dispersion of the preliminary and intermediate product to be separated. The turbulence installations 25 can, for example, be designed using static mixing elements or bluff bodies. However, in addition to or as an alternative to these embodiments, it is also possible to use a dynamic rotor, which further improves the mixing and dispersion of the preliminary or intermediate product. This is additionally improved by the displacement body 26, which can be designed so as to be height-adjustable.

After the dispersing unit 20, the preliminary or intermediate product to be separated is directed to the multi-cyclone 1 according to the invention by means of the carrier gas flow. This is regulated, as already explained in relation to FIG. 1, by operating it in the basic state with regard to the loading of the carrier gas flow, which is adjusted by means of the supply from hopper 42, and the volume per unit of time of the carrier gas flow, which is adjusted via the fan 45, in such a way that in the initial state an almost complete separation of the fine and very fine particles in the multi-cyclone 1 is possible. By supplying cyclone control air via the cyclone control air supply 9, a poorer separation is then achieved, which means that the fine particles in the carrier gas flow are not separated as cyclone grit but are directed further towards filter 30 with the carrier gas flow.

In this filter 30, the very fine particles are also separated and can be discharged from filter 30, for example via a rotary valve 31. The carrier gas flow thus cleaned can be partially fed back into the process or blown out into the environment.

The advantage of the very fine particle separator 40 described here is that it can always be operated in the range of an optimum operating point, irrespective of upstream processes that produce the preliminary or intermediate product, since both the loading and the volume per unit of time of the carrier gas are only defined by the properties of the individual assemblies of the very fine particle separator 40 and do not have to take into account further upstream or downstream processes.

Figure 3:
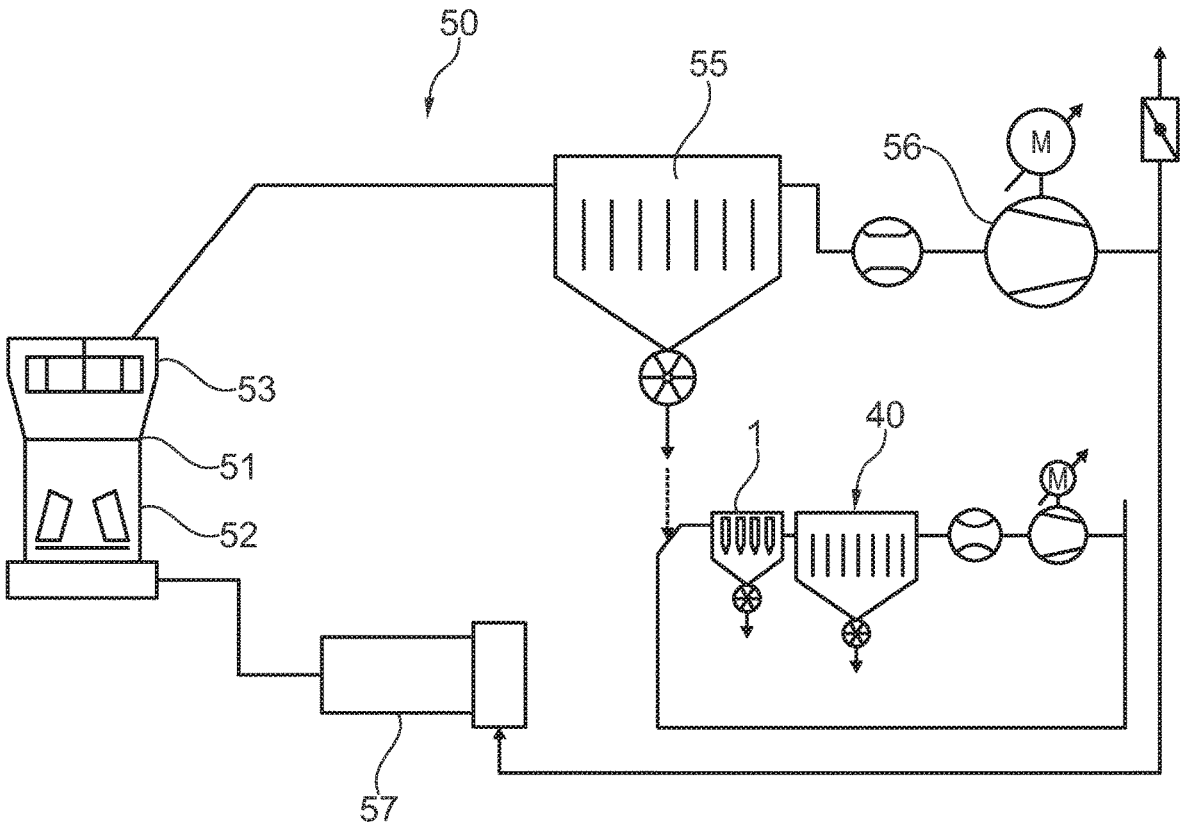
FIG. 3 shows a schematic flow diagram of a grinding plant with very fine particle separator according to the invention.

This is further clarified in the following with reference to FIG. 3. FIG. 3 shows a grinding plant 50 with a mill-sifter combination 51. The mill-sifter combination has a mill 52 and a sifter 53. The ground material comminuted in the mill-sifter combination 51 is transported to a grinding plant filter 55 by means of a grinding plant carrier gas flow, which is adjusted by the mill fan 56. The grinding plant carrier gas flow can be returned again in part via a hot gas generator 57, which, for example, enables a grind drying in the mill-sifter combination.

In the grinding plant filter 55, particles located in the carrier gas flow of the grinding plant are separated. These particles are then fed to the very fine particle separator 40 with a multi-cyclone 1 according to the invention.

This figure shows that by the design of the very fine particle separator 40 accordng to the invention allows it to be operated essentially decoupled from the grinding plant circuit. As a result, both the grinding plant 50 itself and the very fine particle separator 40 each can be operated at optimum operating points, which also depend on the loading of the carrier gas flows with material to be ground or separated and the volume per unit of time of the carrier gas.

For example, conventional grinding plants 50, as shown in FIG. 3 as an example, usually have a carrier gas load in the range of 30 g/m$^3$ to 50 g/m$^3$ with a fineness of up to 6000 cm$^2$/g at their optimum operating point. On the other hand, a multi-cyclone 1 according to the invention and thus also the very fine particle separator 40 can be operated with a load in the range between 200 g/m$^3$ and 300 g/m$^3$. By decoupling, it is thus possible to dimension the very fine particle separator 40 smaller or to provide only one very fine particle separator 40 for several grinding plants 50. This reduces the required plant size and thus minimizes investment costs.

Figure 4:
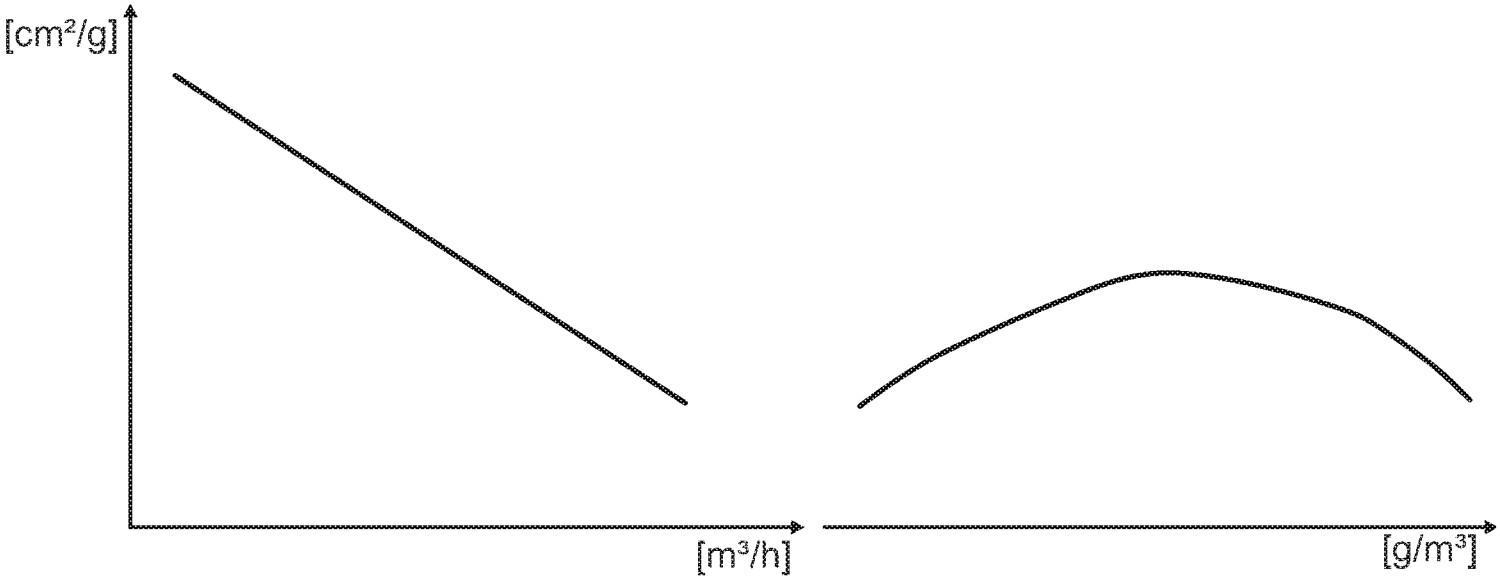
FIG. 4 shows a combined schematic diagram to illustrate the cyclone control air quantity and the dust load of the carrier gas in relation to the fineness.

FIG. 4 shows a combined schematic diagram illustrating the relationship between the cyclone control air quantity and the dust load of the carrier gas in relation to the fineness of the very fine particles.

Here, the fineness in cm$^2$/g of the very fine particles is provided on the ordinate. The cyclone control air quantity in m$^3$/h is shown on the left side of the abscissa and the load of the carrier gas in g/m$^3$ on the right side.

As can be seen from the diagram, the fineness of the very fine particles decreases with increasing cyclone control air quantity. In contrast, for the fineness an optimum dust load or particle load of the carrier gas flow before the multi-cyclone is formed.

From this it can be concluded that, as already described above, there is an optimum operating point for operating a multi-cyclone according to the invention in relation to the loading of the carrier air flow. The fineness of the very fine particles can then be influenced according to a control system using the cyclone control air.

The multi-cyclone according to the invention and its operating method for separating fine and very fine particles thus enable simple and efficient separation of fine and very fine particles as well as a decoupled operation from upstream process plants.

The invention claimed is:

1. A method for operating a multi-cyclone for separating fine and very fine particles comprising:

utilizing a multi-cyclone that comprises:

two or more individual cyclones, each of which comprises a carrier gas inlet opening, a carrier gas outlet opening and a grit discharge opening, whereby the two or more individual cyclones are housed together in a low-infiltrated-air housing, in which an upper and a lower chamber is designed, whereby the carrier gas outlet openings of the two or more individual cyclones are open towards an upper chamber, whereby the upper chamber has a carrier gas overall outlet opening to discharge carrier gas which enters the upper chamber from the respective carrier gas outlet openings of the two or more individual cyclones, via the carrier gas overall outlet opening from a housing of the multi-cyclone, whereby the grit discharge openings are each designed open towards the lower chamber, whereby the lower chamber has a device for the low-infiltrated-air extraction of cyclone grits introduced through the grit discharge openings, enabling an extraction largely free from infiltrated air, whereby a common cyclone control air supply is provided to the lower chamber, wherein:

the carrier gas inlet openings are each supplied from outside the housing with a carrier gas flow of equal volume with the fine and very fine particles to be separated, in the individual cyclones, an at least partial separation of fine and very fine particles is carried out, the fine particles enter the lower chamber as cyclone grit via the grit discharge openings and are discharged from there out of the housing via the device for low-infiltrated-air extraction, whereby the very fine particles are passed as cyclone fines through the upper chamber and the carrier gas overall outlet opening out of the multi-cyclone by means of the carrier gas flow, and the method comprising controlling a quantity per unit of time of cyclone control air fed into the lower chamber by the cyclone control air supply to adjust one or more of a quantity, a fineness, and a purity of the very fine particles fed from the multi-cyclone.

2. The method according to claim 1, wherein a volume per unit of time of carrier gas flows of equal volume to the individual cyclones is adjusted depending on the geometry of the individual cyclones in order to separate approximately 99% of the fine and very fine particles being in carrier gas flows as cyclone grit when the cyclone control air supply is closed.

3. The method according to claim 1, wherein a load of carrier gas flows of equal volume to the individual cyclones with fine and very fine particles is adjusted depending on the geometry of the individual cyclones, in order to separate approximately 99% of the fine and very fine particles being in carrier gas flows as cyclone grit when the cyclone control air supply is closed.

4. The method according to claim 1, wherein:

a pressure difference between the upper and lower chamber is set during operation, and the pressure in the upper chamber is lower than the pressure in the lower chamber.

5. The method according to claim 1, wherein a pressure in the upper chamber and in the lower chamber is set lower than an ambient pressure.

6. The method according to claim 1, wherein the fine and very fine particles to be separated are fed to a dispersing unit, before a feed, in the multi-cyclone and from there transported to the multi-cyclone by means of the carrier gas flow.

7. The method according to claim 1, wherein:

the carrier gas flow with the very fine particles from the carrier gas overall outlet opening is fed to a filter for separating the very fine particles from the carrier gas flow.

8. A multi-cyclone comprising:

two or more individual cyclones, each of which comprises a carrier gas inlet opening, a carrier gas outlet opening and a grit discharge opening, whereby the individual cyclones are housed together in a low-infiltrated-air housing, in which an upper chamber and a lower chamber is designed, whereby the carrier gas outlet openings of the individual cyclones are designed open towards the upper chamber, whereby the upper chamber has a carrier gas overall outlet opening to discharge carrier gas which enters the upper chamber from the respective carrier gas outlet openings of the individual cyclones, via the carrier gas overall outlet opening from a housing of the multi-cyclone, whereby the grit discharge openings in each of the individual cyclones are designed open towards the lower chamber, whereby the lower chamber has a device for the low-infiltrated-air extraction of grits introduced through the grit discharge openings, enabling an extraction largely free from infiltrated air, whereby the carrier gas inlet openings are each designed to be supplied from outside the housing with a carrier gas flow of equal volume, which contains fine and very fine particles to be separated, whereby a common cyclone control air supply is provided to the lower chamber, via which control air is operable to be directed into the lower chamber, whereby a control and regulating device is provided to adjust a quantity, a fineness, and/or a purity of the very fine particles directed from the multi-cyclone by means of a quantity of the cyclone control air per unit of time, and whereby fine particles are operable to be separated as cyclone grit.

9. The multi-cyclone according to claim 8, wherein the individual cyclones are provided in the housing in parallel, flow-wise.

10. The multi-cyclone according to claim 8, wherein the upper chambers and the lower chambers are designed to be airtight to each other, whereby an air exchange between the upper chamber and the lower chamber only takes place via the individual cyclones.

11. A very fine particle separator for separating fine and very fine particles from a preliminary or an intermediate product comprising at least one multi-cyclone comprising:

two or more individual cyclones, each of which comprises a carrier gas inlet opening, a carrier gas outlet opening and a grit discharge opening, whereby the individual cyclones are housed together in a low-infiltrated-air housing, in which an upper chamber and a lower chamber is designed, whereby the carrier gas outlet openings of the individual cyclones are designed open towards the upper chamber, whereby the upper chamber has a carrier gas overall outlet opening to discharge carrier gas which enters the upper chamber from the respective carrier gas outlet openings of the individual cyclones, via the carrier gas overall outlet opening) from a housing of the multi-cyclone, whereby the grit discharge openings in each of the individual cyclones are designed open towards the lower chamber, whereby the lower chamber has a device for the low-infiltrated-air extraction of grits introduced through the grit discharge openings, enabling an extraction largely free from infiltrated air, whereby the carrier gas inlet openings are each designed to be supplied from outside the housing with a carrier gas flow of equal volume, which contains fine and very fine particles to be separated, whereby a common cyclone control air supply is provided to the lower chamber, via which control air is operable to be directed into the lower chamber, whereby a control and regulating device is provided to adjust a quantity, a fineness, and/or a purity of the very fine particles directed from the multi-cyclone by means of a quantity of the cyclone control air per unit of time, and whereby fine particles are operable to be separated as cyclone grit, and a filter, whereby:

the preliminary or the intermediate product is operable to be supplied to the at least one multi-cyclone by means of carrier gas flow, the fine particles are operable to be separated on the multi-cyclone, and by means of carrier gas the very fine particles can be further directed to the filter and separated there.

12. The very fine particle separator according to claim 11, wherein:

two or more multi-cyclones are provided in series, flow-wise, one after another upstream of the filter, and the individual cyclones of the multiple multi-cyclones each feature a smaller diameter in a flow direction of the carrier gas flow.

13. The very fine particle separator according to claim 11, further comprising a storage hopper for the preliminary and intermediate product and a dispersing unit, whereby the preliminary or intermediate product to be separated is fed from the storage hopper via the dispersing unit to the very fine particle separator by means of the carrier gas flow.

14. A grinding plant to produce fine and very fine particles from a raw material with a mill-sifter combination, which features a sifter and a mill, and further comprising:

a very fine particle separator comprising:

two or more individual cyclones, each of which comprises a carrier gas inlet opening, a carrier gas outlet opening and a grit discharge opening, whereby the individual cyclones are housed together in a low-infiltrated-air housing, in which an upper chamber and a lower chamber is designed, whereby the carrier gas outlet openings of the individual cyclones are designed open towards the upper chamber, whereby the upper chamber has a carrier gas overall outlet opening to discharge carrier gas which enters the upper chamber from the respective carrier gas outlet openings of the individual cyclones, via the carrier gas overall outlet opening) from a housing of the multi-cyclone, whereby the grit discharge openings in each of the individual cyclones are designed open towards the lower chamber, whereby the lower chamber has a device for the low-infiltrated-air extraction of grits introduced through the grit discharge openings, enabling an extraction largely free from infiltrated air, whereby the carrier gas inlet openings are each designed to be supplied from outside the housing with a carrier gas flow of equal volume, which contains fine and very fine particles to be separated, whereby a common cyclone control air supply is provided to the lower chamber, via which control air is operable to be directed into the lower chamber, whereby a control and regulating device is provided to adjust a quantity, a fineness, and/or a purity of the very fine particles directed from the multi-cyclone by means of a quantity of the cyclone control air per unit of time, and whereby fine particles are operable to be separated as cyclone grit, and a filter, whereby:

the preliminary or the intermediate product is operable to be supplied to the at least one multi-cyclone by means of carrier gas flow, the fine particles are operable to be separated on the multi-cyclone, and by means of carrier gas the very fine particles can be further directed to the filter and separated there whereby the mill-sifter combination is designed to feed raw material ground at least once during an initial sifting from the sifter of the mill-sifter combination back again to the mill as rejected coarse material for further grinding, with a grinding plant filter, whereby by means of a grinding plant carrier gas flow, ground material not rejected by the sifter of the mill-sifter combination is operable to be transported to the grinding plant filter, and there it is separated from the grinding plant carrier gas flow, wherein:

whereby at least a part of a ground product separated on the grinding plant filter can be fed to the very fine particle separator as preliminary or intermediate product for the separation of fine and very fine particles.

15. The grinding plant according to claim 14, wherein the mill of the mill-sifter combination is a vertical mill with a grinding table and grinding rollers.

* * * * *